US011666804B2

(12) United States Patent
LeBel

(10) Patent No.: US 11,666,804 B2
(45) Date of Patent: Jun. 6, 2023

(54) GOLF CLUB WITH AN ADJUSTABLE SHAFT ANGLE AND METHOD OF ADJUSTING SAME

(71) Applicant: Roger Robert LeBel, Quebec (CA)

(72) Inventor: Roger Robert LeBel, Quebec (CA)

( * ) Notice: Subject to any disclaimer, the term of this patent is extended or adjusted under 35 U.S.C. 154(b) by 91 days.

(21) Appl. No.: 17/175,682

(22) Filed: Feb. 14, 2021

(65) Prior Publication Data

US 2021/0252345 A1 Aug. 19, 2021

Related U.S. Application Data

(60) Provisional application No. 62/981,287, filed on Feb. 25, 2020, provisional application No. 62/976,860, filed on Feb. 14, 2020.

(51) Int. Cl.
*A63B 53/02* (2015.01)

(52) U.S. Cl.
CPC ..... *A63B 53/023* (2020.08)

(58) Field of Classification Search
CPC ... A63B 53/022; A63B 53/023; A63B 53/025; A63B 53/026; A63B 53/027; A63B 53/028
See application file for complete search history.

(56) References Cited

U.S. PATENT DOCUMENTS 5,390,919 A * 2/1995 Stubbs ..... A63B 53/065 473/292
5,511,779 A * 4/1996 Meyers ..... A63B 53/065 473/251
5,603,666 A * 2/1997 Bowe ..... A63B 60/00 473/307
5,692,969 A * 12/1997 Schooler ..... A63B 60/00 473/340
7,367,896 B2 * 5/2008 Jackson ..... A63B 53/007 473/340

* cited by examiner

*Primary Examiner* — Michael D Dennis
(74) *Attorney, Agent, or Firm* — Bycer & Marion, PLC; Matthew L. Bycer; Michael B. Marion

(57) ABSTRACT

The present invention relates to a golf club with an adjustable shaft angle and a method of adjusting the same. More specifically, the invention provides a golf club head, a rotating mechanism and a shaft. The rotating mechanism comprises a sphere easily rotatable within predetermined limits so that the angle of the shaft may be adjusted to desired values which fall under the restrictions of golfing ruling authorities. A method is also provided so as to adjust the angle of the above-mentioned shaft.

13 Claims, 23 Drawing Sheets

GOLF CLUB WITH AN ADJUSTABLE SHAFT ANGLE AND METHOD OF ADJUSTING SAME

CROSS-REFERENCE TO RELATED APPLICATIONS

This application claims priority from U.S. provisional Patent application Nos. 62/976,860 and 62/981,287 entitled ADJUSTABLE GOLF CLUB filed on Feb. 14 and Feb. 25, 2020, respectively, herein incorporated by reference.

FIELD OF THE INVENTION

The present invention generally relates to golf clubs, more specifically to golf clubs, with an adjustable shaft position.

BACKGROUND OF THE INVENTION

Golf is a sport where different configurations of clubs may be required depending on a variety of factors; distance for the ball to travel, angle to hit, type of ground, etc. In some instances, especially when the ball travel distance is short and the ball is positioned on the putting green, a putter may be preferred. A putter generally has a very flat and low striking face and is generally used to make the ball roll on the green and into a hole. As such, putters are used in situations in which a great dose of stroke precision and ball control are necessary.

There are many factors influencing the configuration of a putter. For example, it may be the player's physical characteristics such as height, limbs length, strength, etc. It may also be the fact that the player is right or left handed. Often, a player may require different putters with different properties so as to be efficient in multiple scenarios. Many players may not have the funds necessary to invest in multiple putters and may thus be equipped with a less than ideal putter for any given situation.

There are already solutions known in the art wherein different aspects of a golf putter may be changed, such as putter weight, shaft angle, etc. Sadly, and similarly to other prior art documents, adjusting the many aspects of a golf putter head often requires tools and time which makes the changes frustrating for the players. More so, an acceptable solution must preferably be acceptable for both professional and casual players and must therefore respect the limitations imposed by the different ruling bodies of golfing such as R&A, USGA and Golf Canada. One such limitation is the angulation limits of the putter's shaft.

Therefore, there is a need for a solution allowing the adjustability of a shaft's angle relative to the putter head that is convenient for a golf player while obeying the limitations of golfing ruling bodies.

SUMMARY OF THE INVENTION

The shortcomings of the prior art are generally mitigated by a golf club head comprising an adjustable shaft angle wherein the adjustment mechanism is simple and in which the club's possible configurations respect the limitations of golfing ruling authorities.

The above-mentioned results may be obtained with the present invention that provides a golf club head, a shaft and a rotating mechanism linking both components and limiting rotational movement within predetermined limits so that the angle of the shaft may be adjusted to desired values which fall under the restrictions of golfing ruling authorities.

In a first embodiment, the golf club head comprises a spherical cavity fitted to receive a sphere. The rotating mechanism comprises a sphere, a shaft hole and a covering plate. The shaft is installed in the shaft hole of the rotating mechanism. The covering plate is installed over the sphere and part of the club head and may restrict the shaft's movements and only allow rotations of the same respecting the angle values imposed by golfing ruling authorities.

In another embodiment similar to the first, the rotating mechanism further comprises a limiter installed in the bottom of the sphere. A bottom limiting cavity is located under the spherical cavity wherein the portion sticking out of the sphere of the limiter may be positioned. The shaft is installed in the shaft hole of the rotating mechanism. The bottom limiting cavity has limiting walls dimensioned so that the limiter may only allow rotations of the shaft respecting the angle values imposed by golfing ruling authorities. Covering the rotating mechanism and limiting its rotation once fully installed is a covering plate that may connect with the club head.

In another embodiment, the golf club head comprises a cavity made to receive a retaining block. The cavity may be positioned anywhere on the club head. The sphere of the rotating mechanism is comprised, in part or fully, in the retaining block which may initially come separately from the putter head. The retaining block may act similarly to a covering plate once it is installed in the putter head so as to limit and stop the rotation of the sphere.

In yet another embodiment, the retaining block may comprise similar aspects to the one mentioned above, but may be slideably installed to the club head. One way to slideably install a retaining block to the club head may be a system of rails.

In a further embodiment, the club head may have varying shapes to accommodate player's preferences and needs. Any shape may be coupled with any of the rotating and retaining mechanisms.

The invention also provides a method of adjusting the angle of a club shaft.

While the above mentioned embodiments may generally be applied to putters, it is to be understood that the invention also provides similar embodiments as presented above and comprising the same aspects, except for the putter head which may be replaced by any other golf club head.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which.

DETAILED DESCRIPTION OF THE PREFERRED EMBODIMENT

A novel adjustable golf shaft position device and method will be described hereinafter. Although the invention is described in terms of specific illustrative embodiments, it is to be understood that the embodiments described herein are by way of example only and that the scope of the invention is not intended to be limited thereby.

Figure 1:
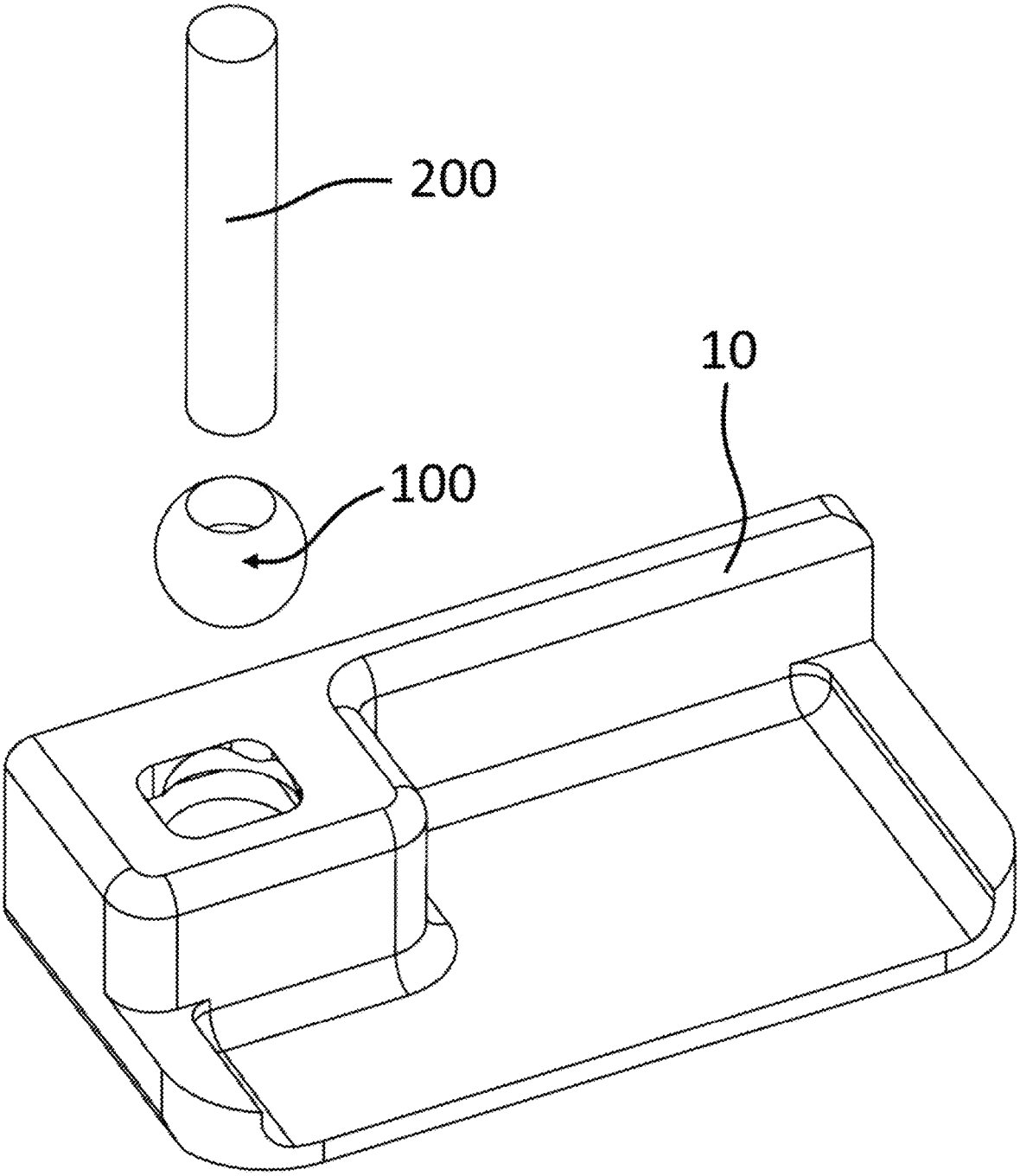
FIG. 1 is an exploded perspective view of a golf club with an adjustable shaft angle.

FIG. 1 represents a perspective view wherein the three main components of the invention may be observed. First is a golf club head 10 made so as to get in contact with a golf ball (not shown) and to support the other components. The golf club head 10 may be any kind of golf club head, but in this instance, it is a putter head. The club head 10 may have many different shapes and designs, some may be aesthetics while others may be functional. The club head 10 presented in the invention mostly focuses on the main section wherein most of the weight is localised and wherein the connection with other parts of the invention is made. The main section of the head 10 is generally localised close to the striking face, but may move depending on other characteristics desired which are to be out of the scope of the invention. Second is a shaft 200 used to control the movements of the club head 10 when playing. The shaft 200 may have any specification desired by a player and allowable by golfing ruling bodies. Third is a rotating mechanism 100 which may have varying shapes and designs, but in all embodiments, may be used to connect the head 10 with the shaft 200.

Figure 2:
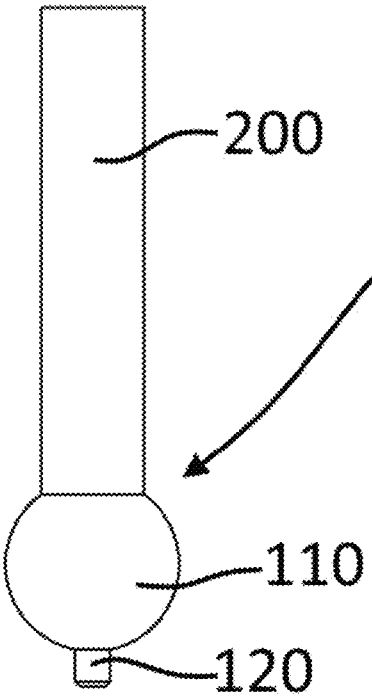
FIG. 2 is a side view of a rotating mechanism.
Figure 3:
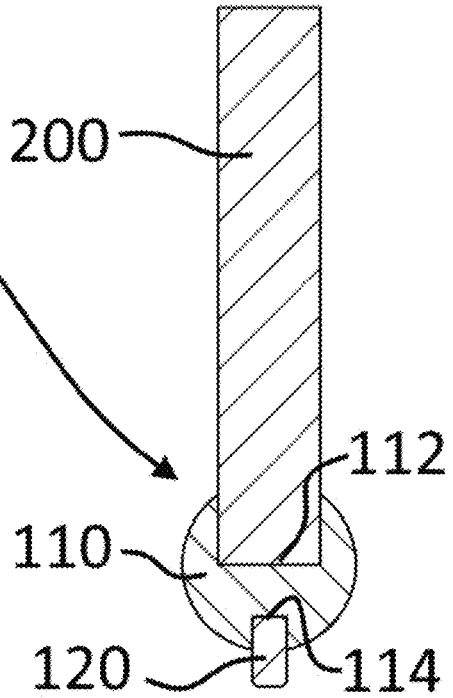
FIG. 3 is a side sectional view of the rotating mechanism of FIG. 2.
Figure 4:
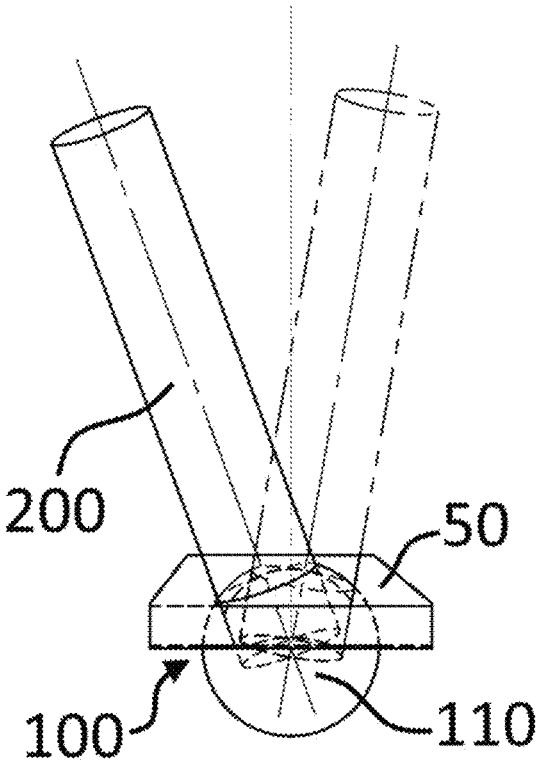
FIG. 4 is a side view of a rotating mechanism comprising a retaining block.
Figure 5:
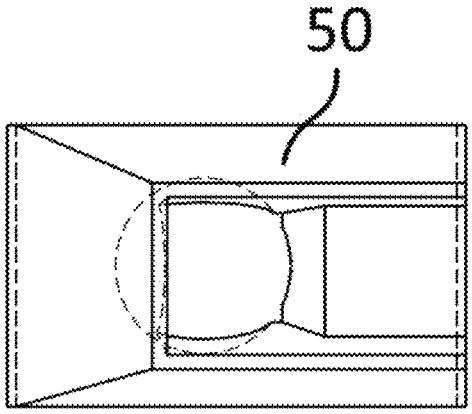
FIG. 5 is a top view of a rotating mechanism comprising a retaining block.
Figure 6:
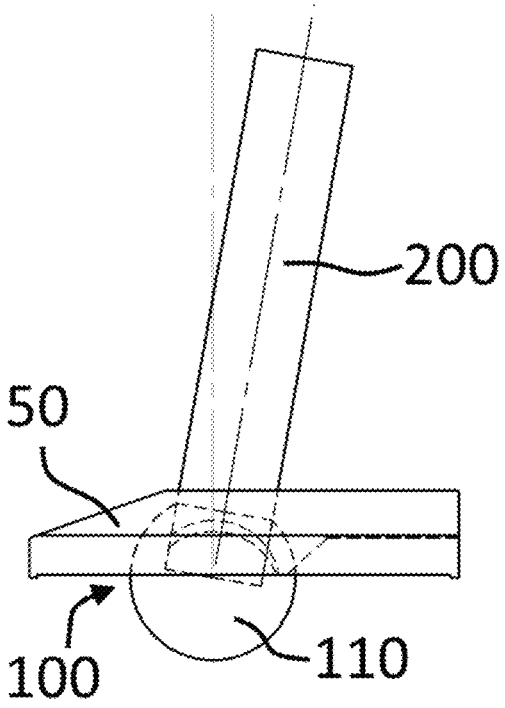
FIG. 6 is a back view of a rotating mechanism comprising a retaining block.
Figure 7:
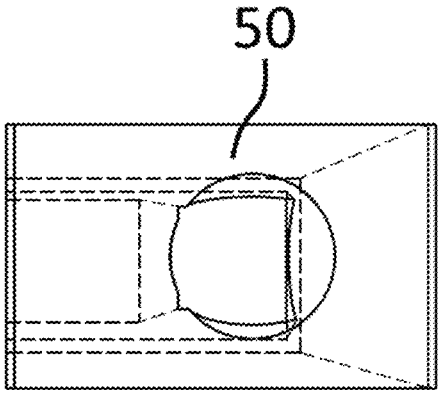
FIG. 7 is a bottom view of a rotating mechanism comprising a retaining block.

Now referring to FIGS. 2 and 3, the rotating mechanism 100 may be first embodied as a sphere 110. The sphere 110 comprises one hole 112, situated on a top surface of the sphere, so as to allow the insertion and fixation of another component.

In a second embodiment, the sphere 110 now comprises two holes (112, 114) so as to allow the insertion and fixation of components in each. Both holes must have the same center axis. The hole 112 situated on the top surface of the sphere 110 is to be generally bigger than the hole 114 situated on the bottom section of the same, but may also be of equal of smaller size if required.

Now back to the hole 112 on the top surface of the sphere 110. It may have a shape akin to the outside shape of the shaft 200, but slightly larger, in order for the latter 200 to tightly be encompassed when pressed into the first 112. Any methods of securing the shaft 200 into the sphere's hole 112 may be used, but the preferred method is by gluing the assembly together. The preferred glue to be used is, but not limited to, epoxy and may be applied between both parts surface and at the intersection corners.

Still with the embodiment of FIGS. 2 and 3, a limiter 120 (also referred to as a governor) may be installed in the lower hole 114. The limiter 120 may have any shape, as long as it is elongated enough to be strongly secured into the sphere 110 on one end and in contact with another object with its protruding end. Any method of securing the limiter 120 into the sphere 110 may be used, but the preferred one is the use of a dowel pin, which simply requires a forceful enough insertion of the pin into the hole 114. Similarly to the shaft 200 in the top hole 112, glue may be applied around the limiter's 120 faces in contact with the sphere 110 to secure it more solidly.

Presented in FIGS. 4 to 7 is a further embodiment of the rotating mechanism 100 comprising a covering plate 50. In this embodiment, the rotating mechanism 100 of FIGS. 2 and 3 may be supplemented with a retaining surface. The covering plate 50 may have, but is not limited to, a generally square or rectangular shape and may encompass partly the sphere 110. There is an opening with enough space on its upper surface to at least allow the shaft 200 to stick out of the sphere 110 and freely move within the confines of acceptable shaft angles defined by the golfing ruling authorities. The covering plate 50 may be secured to the club head 10 by any means known in the art. For example, holes going from the top to the bottom surface of the plate 50 may allow the insertion of fasteners down to similar holes in the head's body 10. In another example, turn locks may be employed. Once secured to the club head 10, the covering plate 50 may be pressed against the sphere 110 so that it may consequently be immobilized. Furthermore, there is the possibility of partly securing the covering plate 50 over the sphere 110 when adjusting the angle of the shaft 200. Indeed, there may be enough friction on the sphere 110 for the shaft 200 to stay put unless force is applied to it by a player. Consequently, this would give enough time and stabilization to a player to fixedly secure the covering plate 50 once the right shaft angle is found.

Figure 8:
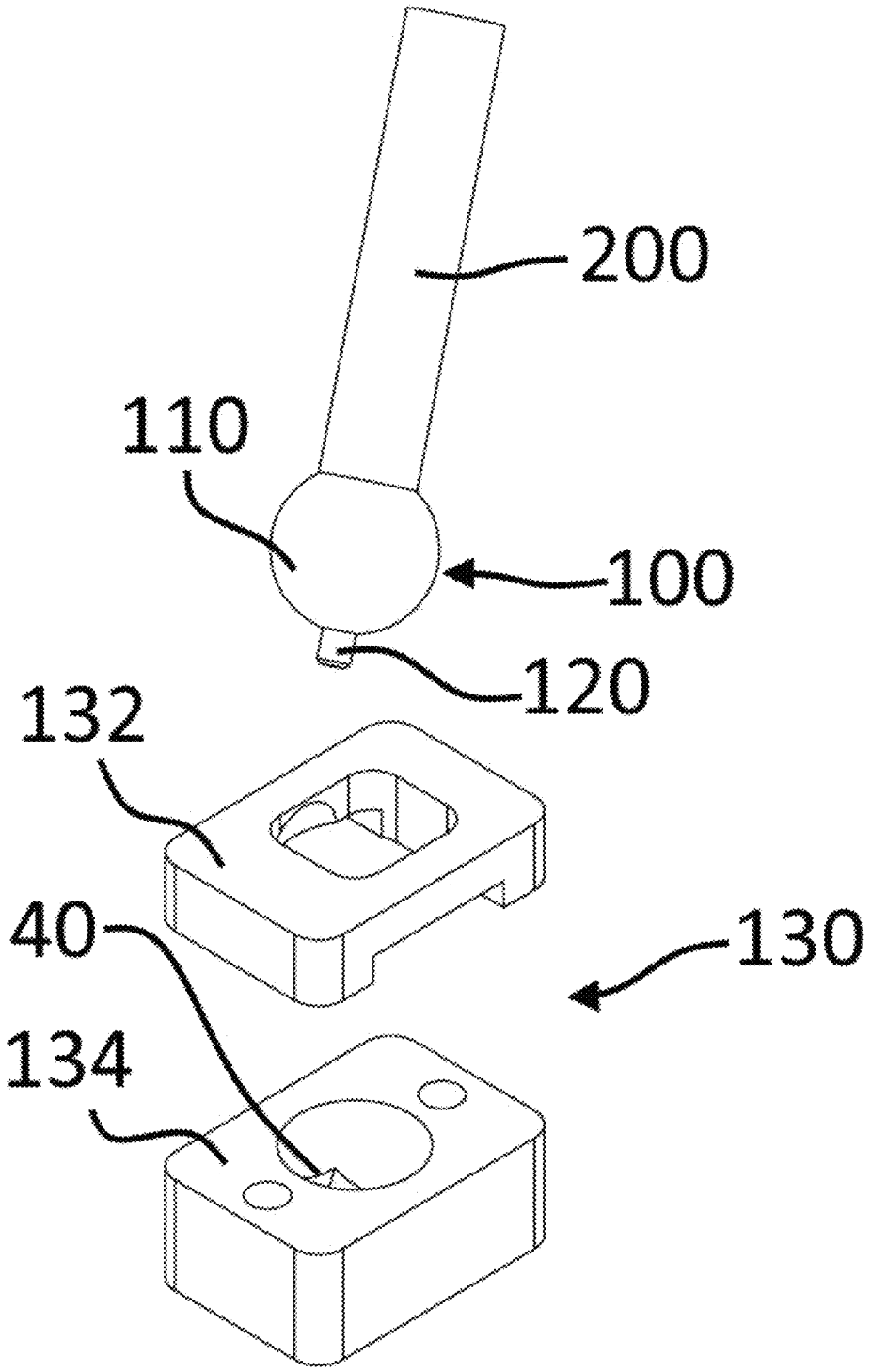
FIG. 8 is a perspective exploded view of a rotating mechanism with shaft and of a retaining block.

FIG. 8 further show an exploded view of an embodiment wherein the rotating mechanism 100 may be housed within a retaining body 130, or retaining block. In this embodiment, the sphere 110 may be entirely housed within the retaining block 130. The retaining block 130, may have a top portion 132 similar in design and in function to the covering plate 50 which may have an opening allowing the shaft 200 to rotate and limiting its rotation to the angles allowed by golfing ruling authorities. The retaining block 130 may generally be comprised of two main parts, the first being the abovementioned top portion, or upper portion, 132 and the second being a lower portion, or bottom portion, 134. Using a retaining block 130 may have multiple advantages. One of them is a prolonged smooth rotation of the sphere 110 inside its block confines since the amount of fluid reducing the friction, oil for example, would not diminish every time the angle is adjusted by fully removing and putting back the sphere 110, unlike in other embodiments. More so, this embodiment may allow simpler methods of connecting the rotating mechanism 100 to the club's head 10 requiring a smaller amount of different parts, therefore reducing the chances of losing parts of the invention when changing the angle of the shaft 200.

Both the covering plate 50 and the retaining block 130 may limit the rotation of the sphere 110 in a multitude of ways. For example, a first limiting mechanism may be a small cavity 40 under the sphere, but still in the confines of the retaining block, constricting the movements of the limiter 120 only to desired angle values. In another example, a second limiting mechanism, similar to the first one, may be by having an opening trough the bottom surface of the retaining block 130 wherein the limiter 120 may stick out of. In this case and in the embodiments having a covering plate 50, it may be walls 42 of the club's head that may restrict the movements of the limiter 120 when entering in contact with. In a final example and with a third mechanism, the sphere 110 may not require a limiter 120 as its rotations would be limited by the shaft 200 entering in contact with the corners of the opening on the top portion 132 of the retaining block 130 or of the covering plate 50. Examples of limiting mechanisms will further be detailed below.

Figure 9:
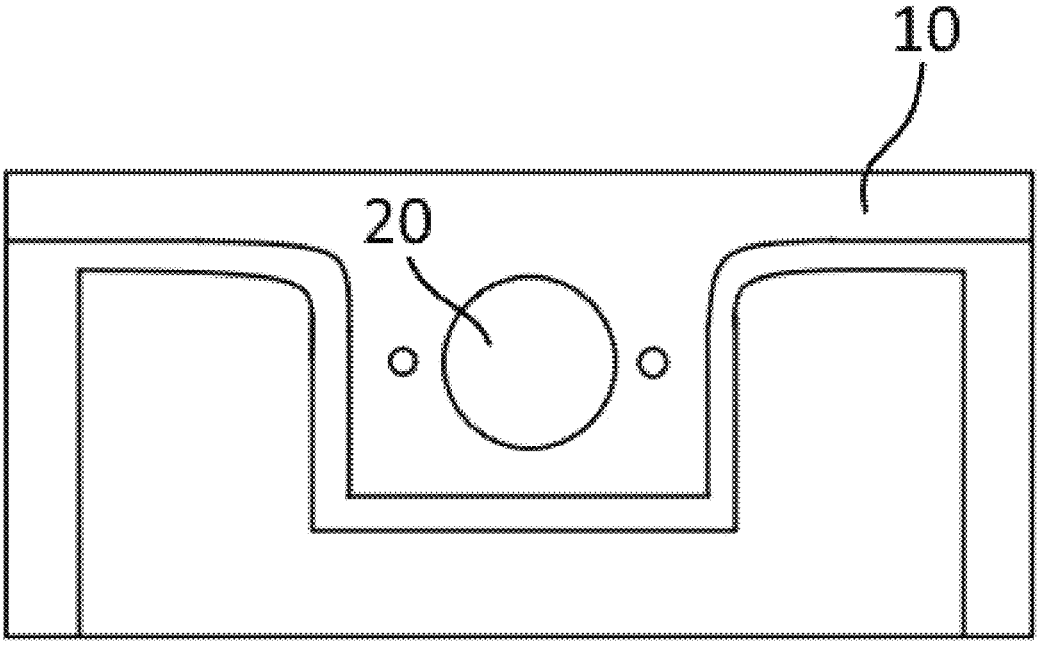
FIG. 9 is a top view of an embodiment of the club head manufactured to receive a rotating mechanism without retaining block wherein there is no level difference for a covering plate.

The putter head 10 illustrated in FIG. 9 is an embodiment in which the head 10 is manufactured to receive a rotating mechanism 100 comprising a sphere 110 with no retaining block 130. It can be seen that a spherical cavity 20 is located as to receive the sphere 110 and encompass at least part of it. A small surface level difference may be present on the top surface of the head 10 and around the spherical cavity 20 as to allow the placement of a covering plate 50. Though, on the embodiment of FIG. 9, no significant surface difference is shown. The covering plate 50 may be secured to the club head's body in any ways known in the art and similar securing examples as the securing of the retaining block 130 to the club head's body 10 are applicable to this plate 50.

Figure 10:
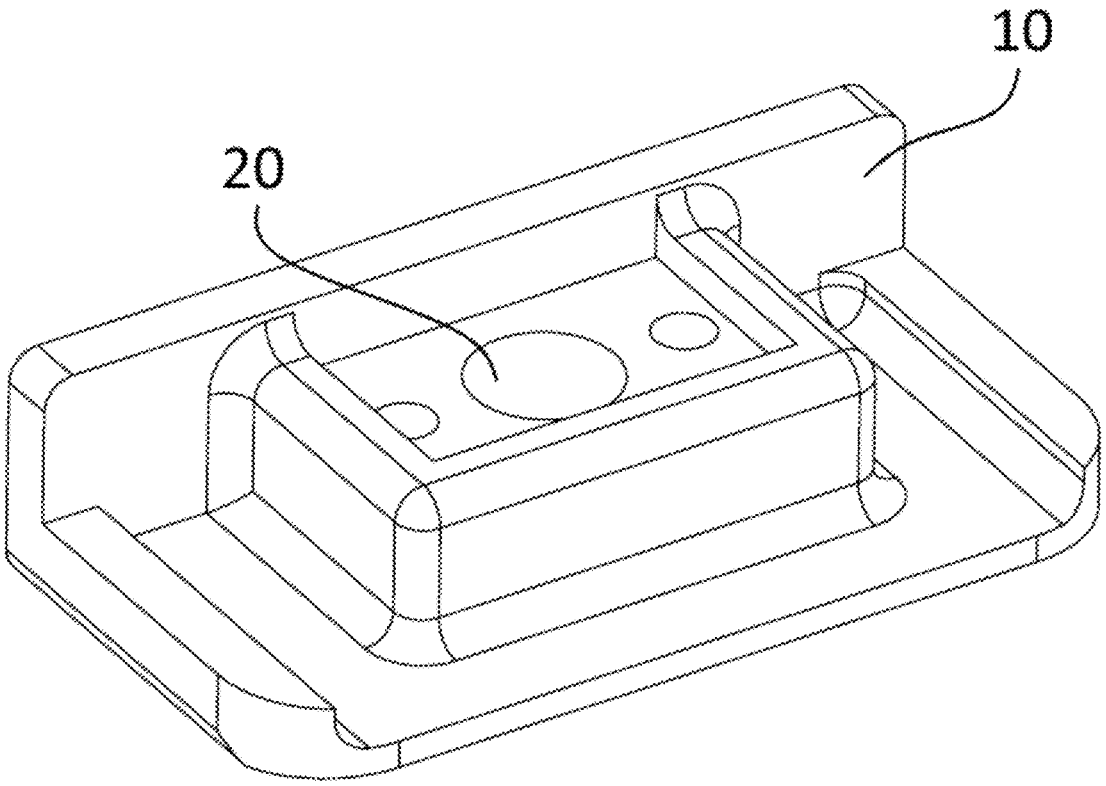
FIG. 10 is a top perspective view of an embodiment of the club head manufactured to receive a rotating mechanism without retaining block wherein there is a level difference for a covering plate.
Figure 11:
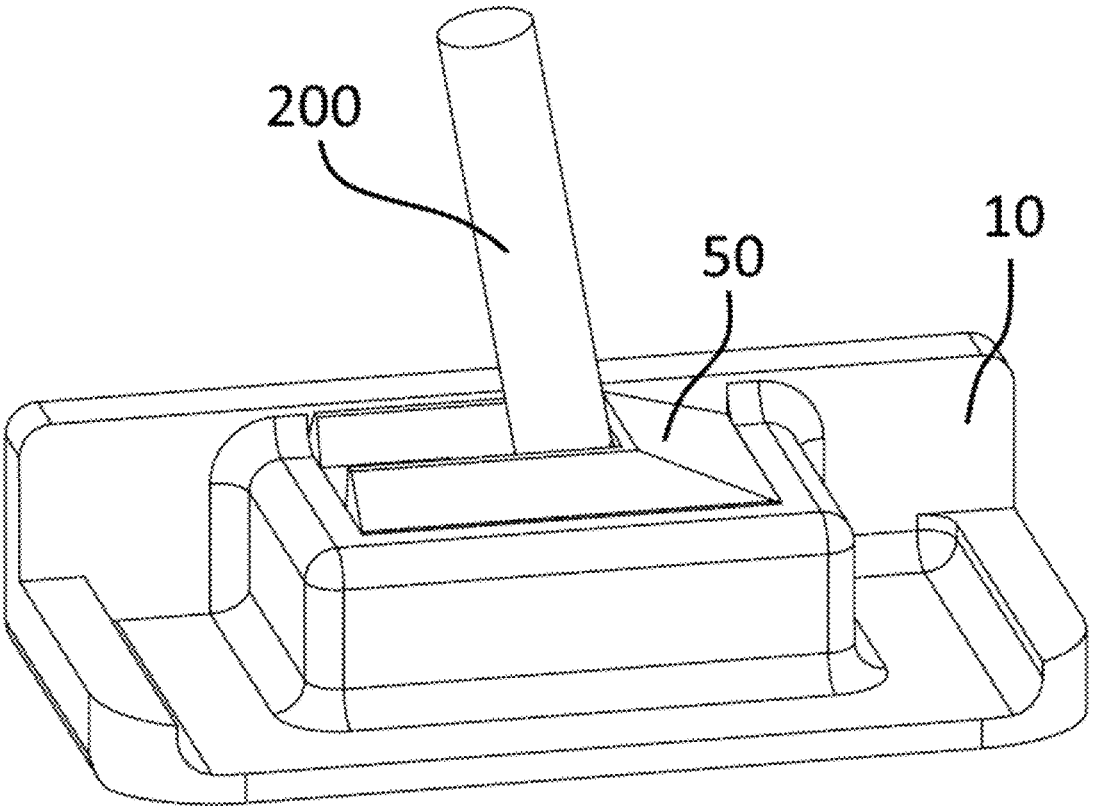
FIG. 11 is a perspective view of an embodiment of the club head with a rotating mechanism and covering plate installed.

The club head 10 illustrated in FIGS. 10 and 11 is an embodiment in which the head 10 is manufactured to receive a rotating mechanism 100 comprising a sphere 110 with no retaining block 130. The difference with the embodiment of FIG. 9 is that there is a surface level difference around the sphere 110 to allow the insertion of a covering limiter plate 50. FIG. 10 shows the club head 10 only wherein FIG. 11 shows the same club head 10 with the rotating mechanism 100 and cover plate 50 installed. An advantage of such an embodiment over the precedent one is that the top of the covering plate 50 may be substantially leveled with the top surface of the club 10. It may further provide better stabilization of the covering plate 50 while simultaneously being more aesthetically pleasing.

Figure 12:
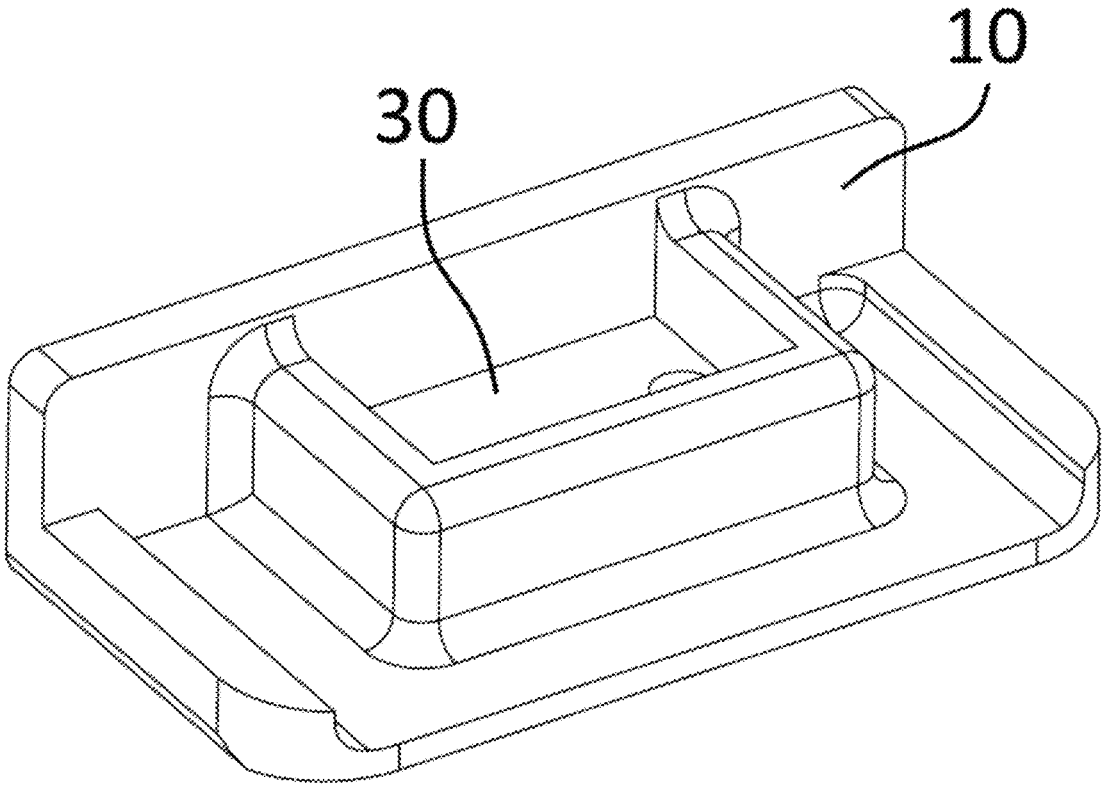
FIG. 12 is a perspective view of an embodiment of the club head manufactured to receive a rotating mechanism with a retaining block.

The club head 10 illustrated in FIG. 12 is an embodiment in which the head 10 is manufactured to receive a rotating mechanism 100 comprising a sphere 110 housed in a retaining block 130. The head 10 comprises a cavity 30 designed to receive partly or entirely a retaining block 130. Compared to the other embodiment described above, there is no sphere cavity 20 on the club head 10 since it is already housed within the retaining block 130.

Figure 13:
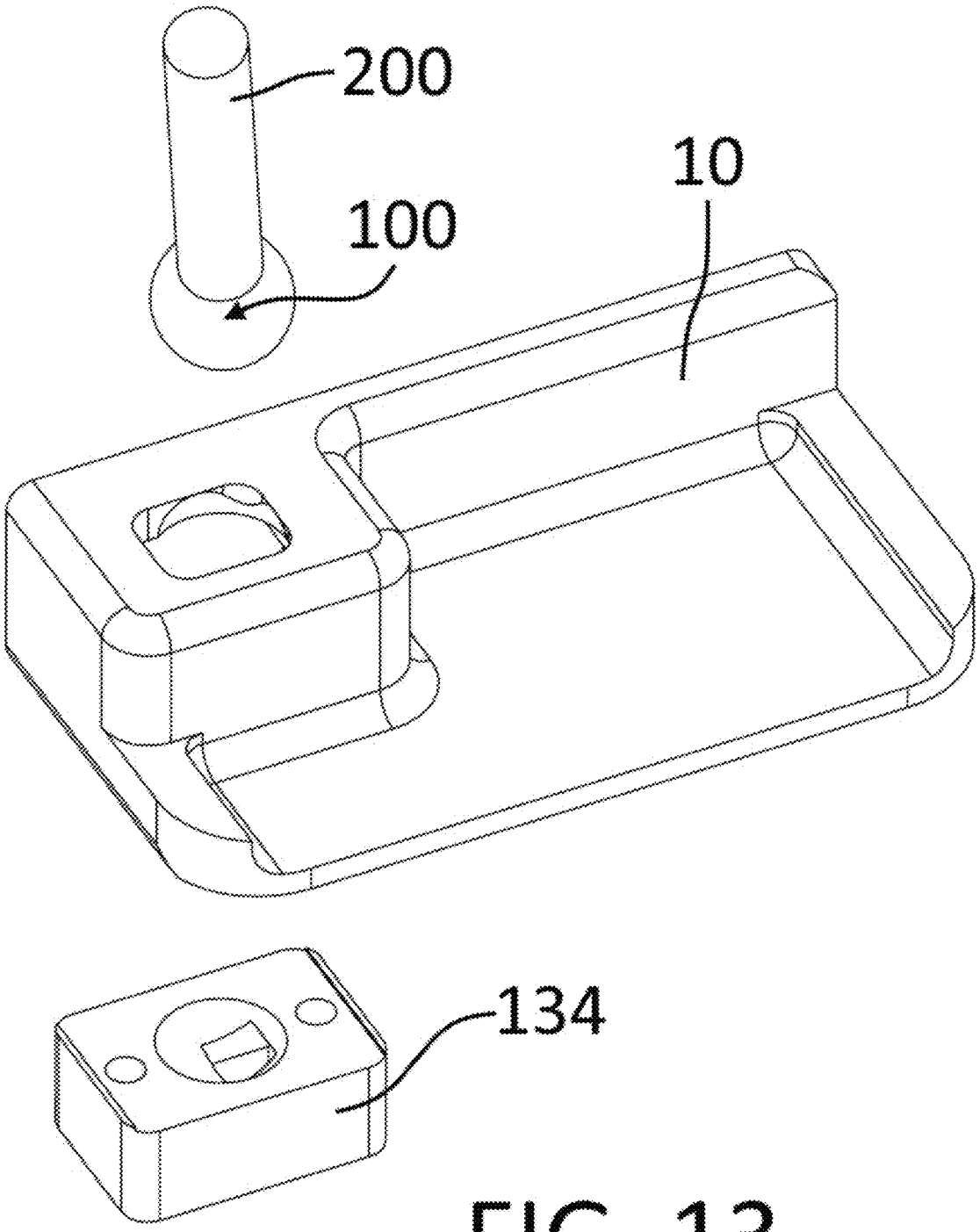
FIG. 13 is a perspective exploded view of a rotating mechanism with shaft and of a retaining block's bottom portion.
Figure 14:
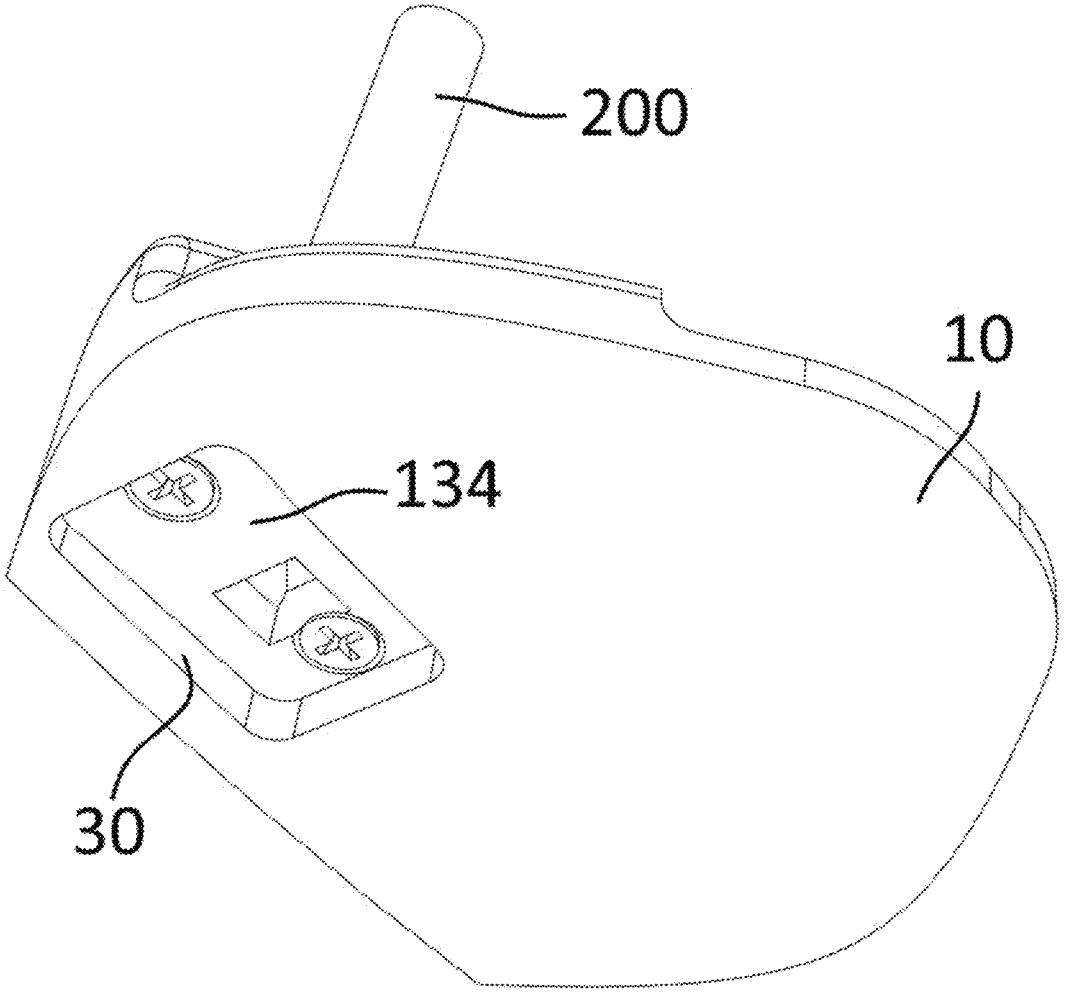
FIG. 14 is bottom perspective view of an embodiment of the invention wherein a retaining block is installed from the bottom of the club head.
Figure 15:
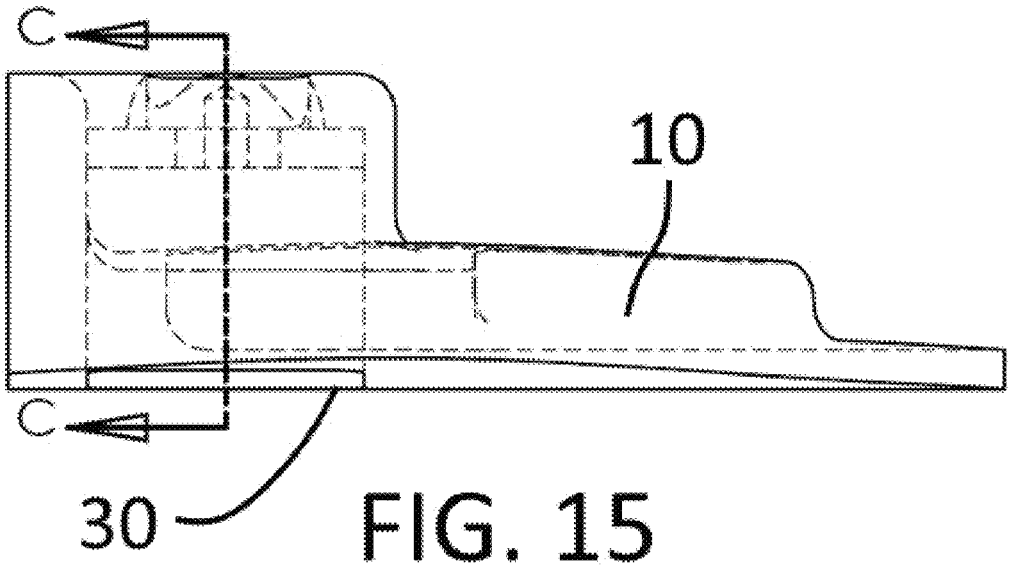
FIG. 15 is a side view of an embodiment of the invention wherein the club head comprises a bottom opening for receiving a bottom portion of a retaining block.
Figure 16:
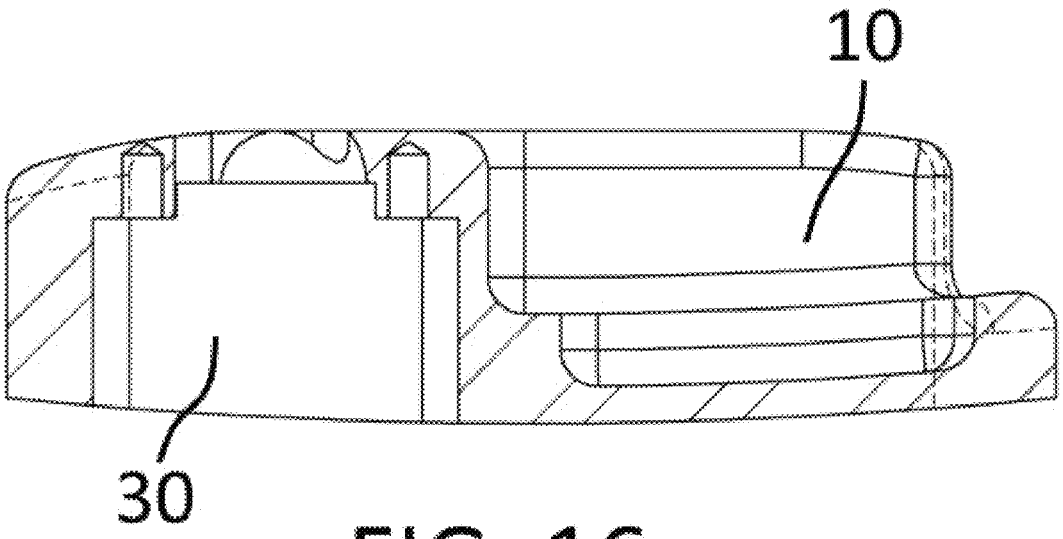
FIG. 16 is a sectional view from FIG. 15 showing the bottom opening its screw holes.

Seen in the exploded view of FIG. 13 and the bottom perspective view of FIG. 14 is an additional embodiment with a retaining block 130. In this embodiment, the retaining block 130 only comprises a bottom portion 134. The top portion usually found in other embodiments 132 is instead already integrated to and part of the club head 10. As such, the rotating mechanism 100 and the bottom retaining portion 134 may be installed by accessing from the bottom of the club head 10 where is located an opening 30. The opening 30 may have multiple shapes, but is generally designed to perfectly and entirely house an inserted retaining block 130. Similarly to other embodiments, the bottom portion 134 of the retaining block 130 may be secured by any means known in the art, such as screws. FIG. 15 further shows a side view of a club head 10 with a bottom opening and FIG. 16 shows a sectional view from the past figure. The housing compartment for a bottom portion 134 of a retaining block 130 may be observed with two holes on its side for the securing of screws.

Figure 17:
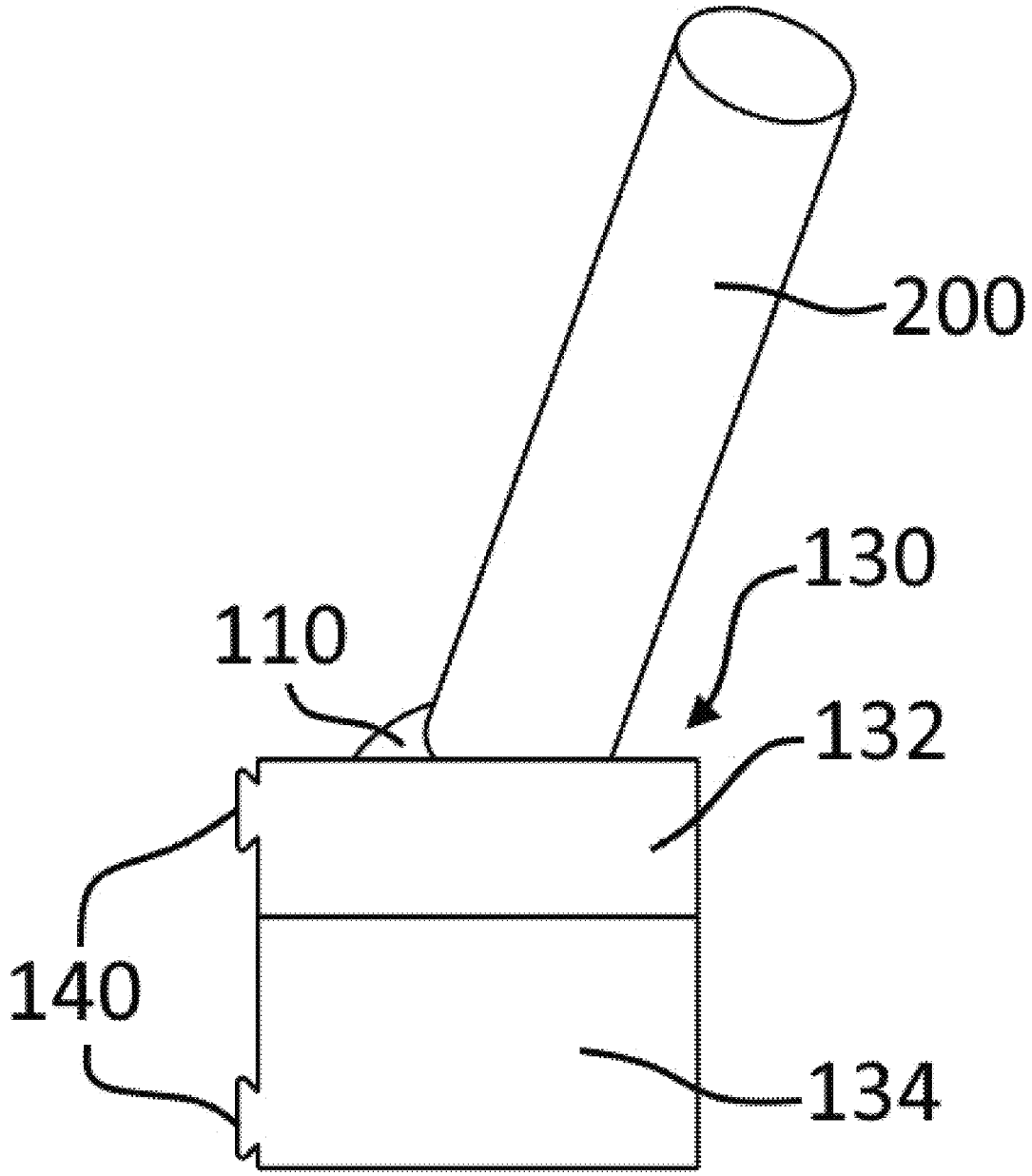
FIG. 17 is a side view of an embodiment of the invention comprising a rail mechanism installed on a retaining block.

In another embodiment shown in FIG. 17, a retaining block 130 is manufactured so as to have upper and lower frames 140 situated on its top and bottom edges. The frames 140, or rails, are suited to slideably embark into a rail system located on the club head 10 and may be situated on any side or surface of the retaining block 130. The rail system may further be situated on any convenient place on the club head 10. The retaining block 130 may partly house the sphere 110 and may have a top portion with a hole manufactured with golfing ruling authorities' shaft angular limits in mind. Once in place, the retaining block 130 may be secured by any mean known in the art, like screws.

Figure 18:
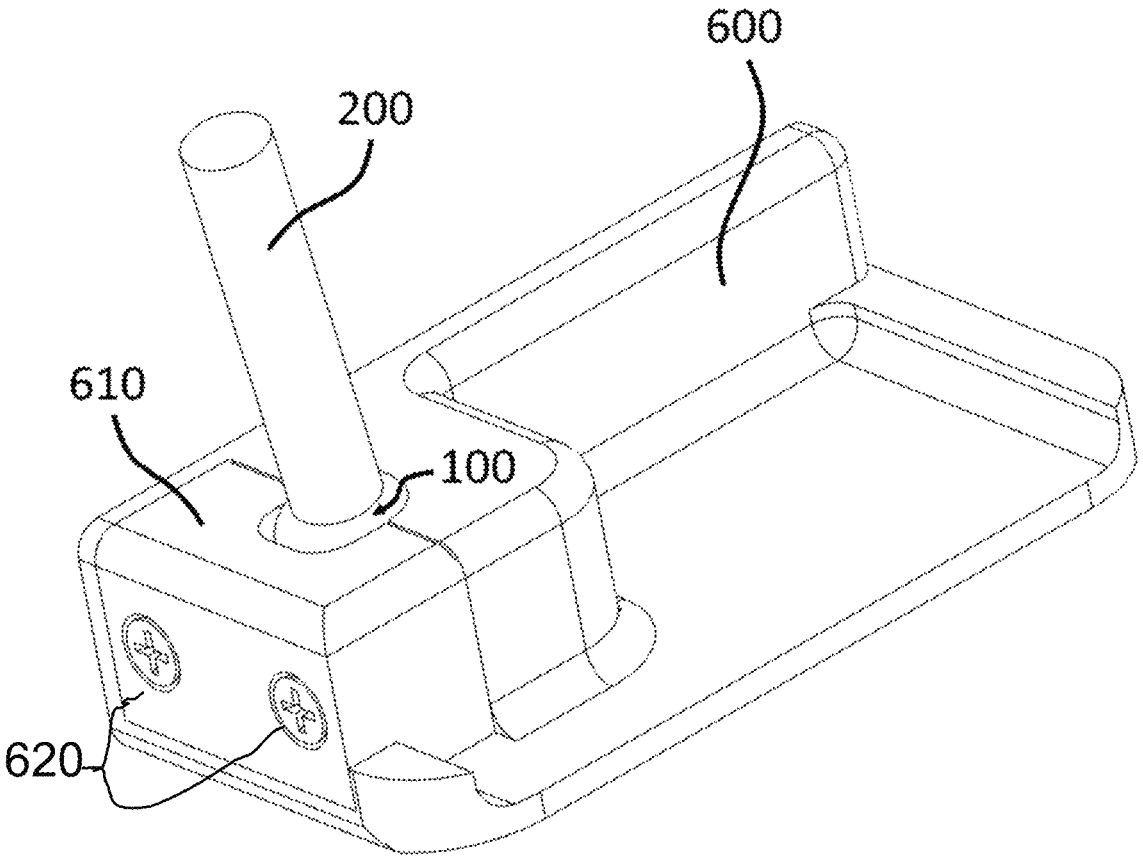
FIG. 18 is a top perspective view of an embodiment of the rotating mechanism comprising a side retaining block.
Figure 19:
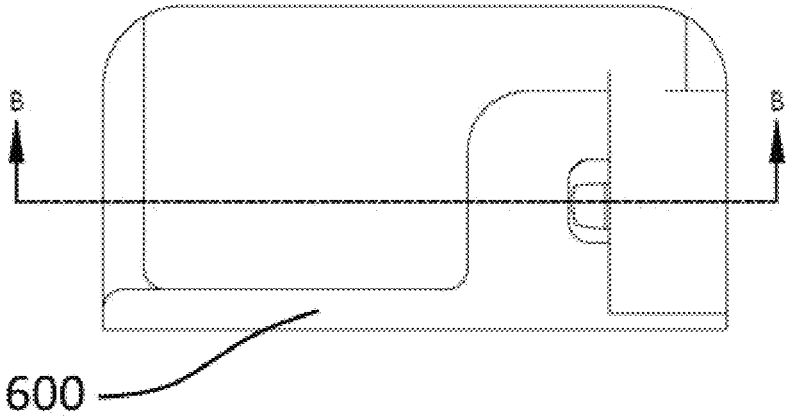
FIG. 19 is a top view of the club head of FIG. 18.
Figure 20:
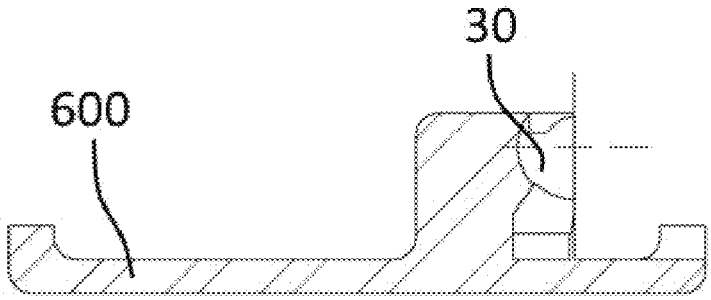
FIG. 20 is a sectional view of the embodiment of FIG. 19 showing part of the limiting mechanism housed within the club head.
Figure 21:
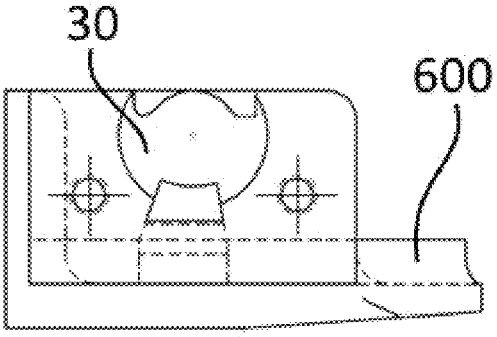
FIG. 21 is a side view of the embodiment of FIG. 19.

In a further embodiment seen in FIG. 18, the retaining block is embodied as a side block 610. The side block 610 may comprise the same limiting aspects as the previously presented top and/or bottom portions (132, 134) for angulation control of a sphere 110 and its shaft 200. In the embodiment shown in FIGS. 19, 20 and 21, part of the limiting mechanism is integrated into the club head 600 and the other is integrated into the side block 610. In other embodiments, the limiting aspects may all be integrated into the side block 610. The main difference over other securing mechanism is that the side block 610 may be slideably inserted over the rotating mechanism 100 from the side of the club head 600 instead of from the top or bottom. The side block 610 may be slid in a plethora of different ways, rails being one. In this embodiment, there is no guiding mechanism to slide the side block 610 as it may simply be inserted on the required area. The block 610 may further be secured with many different methods, set screws 620 as shown being one of them. The set screws 620 may be inserted from many directions on the side block 610, as long as the end protrudes in the club head 600 for fixation. In some cases, players may prefer this embodiment if the side of the club head 600 is more easily accessible to them when adjusting or installing the sphere 110 compared to the bottom.

Figure 22:
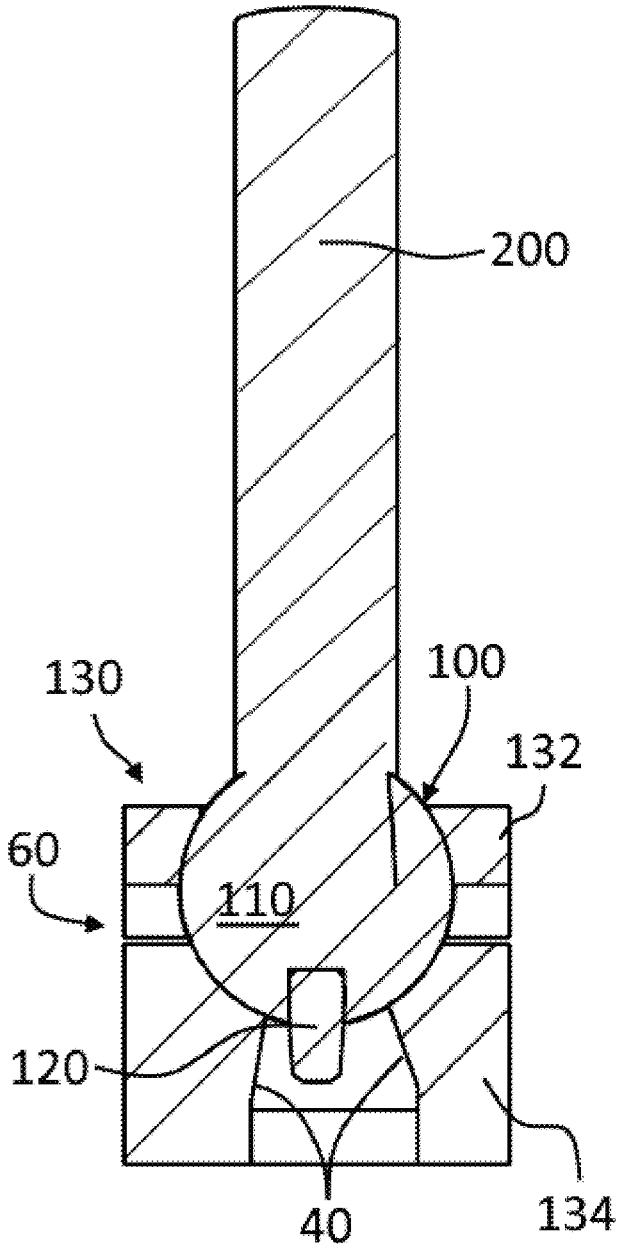
FIG. 22 is a side sectional view of an embodiment of the rotating mechanism with the limiting walls wherein the shaft may rotate on both side of the vertical axis of the club head.
Figure 23:
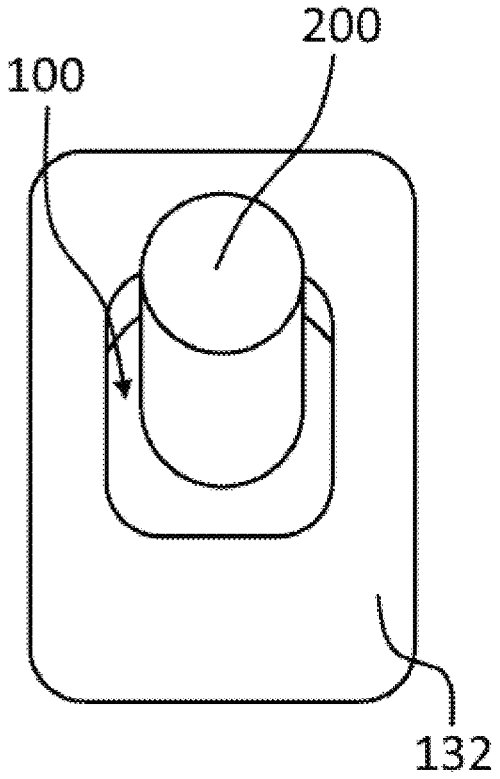
FIG. 23 is a top view of the embodiment of FIG. 14.

FIG. 22 shows a sectional view of a first limiting mechanism embodiment. Specifically, it is a sectional view of a rotating mechanism 100 comprising a sphere 110, a shaft 200 and a limiter 120, and of the body 60 encompassing the rotating mechanism 100. The body 60, as described above, may be a retaining block 130, a covering plate 50, a club head 10 or a combination thereof. In such an embodiment, the sphere 110 may rotate in its housing 60 so that the shaft 200 position may vary to accommodate the desired angle. The limiter 120 is protruding from the bottom of the sphere 110 and has a certain amount of available space. The limiter's 120 range of movement is restricted by limiting walls 40. The walls' 40 faces are at a predetermined angle from the vertical axis of the club head 10. In this embodiment, a first wall is at a 10 degrees angle from the vertical axis while the opposite wall is at a 20 degrees angle from the same axis in the opposite direction. Walls 40 may be manufactured so as to have any value required by golfing ruling authorities. FIG. 23 further shows the configuration of the embodiment of FIG. 22, but from a top view. It may be appreciated from this view that the retaining block's top portion's 132 opening walls may be designed to stop the shaft 200 once it is at maximal position acceptable to golf ruling authorities. The possibility of having the shaft 200 rotate from one side of the vertical axis to the other may allow a player to adjust his shaft 200 angle before a match if he cannot swing as he usually does. The angulations of this embodiment are generally applicable to the plane perpendicular to the striking surface of the club head 10, therefor sideways from a player's position. For example, in a preferred embodiment, the top of the shaft may rotate 10 degrees towards the striking surface and 20 degrees away from the striking surface. Dimension and angular values presented in the example above represent an embodiment of the invention for a right-handed player, opposite values being for a left-handed player, and may be modified to any other value as required by the player and allowable by golfing ruling authorities.

Figure 24:
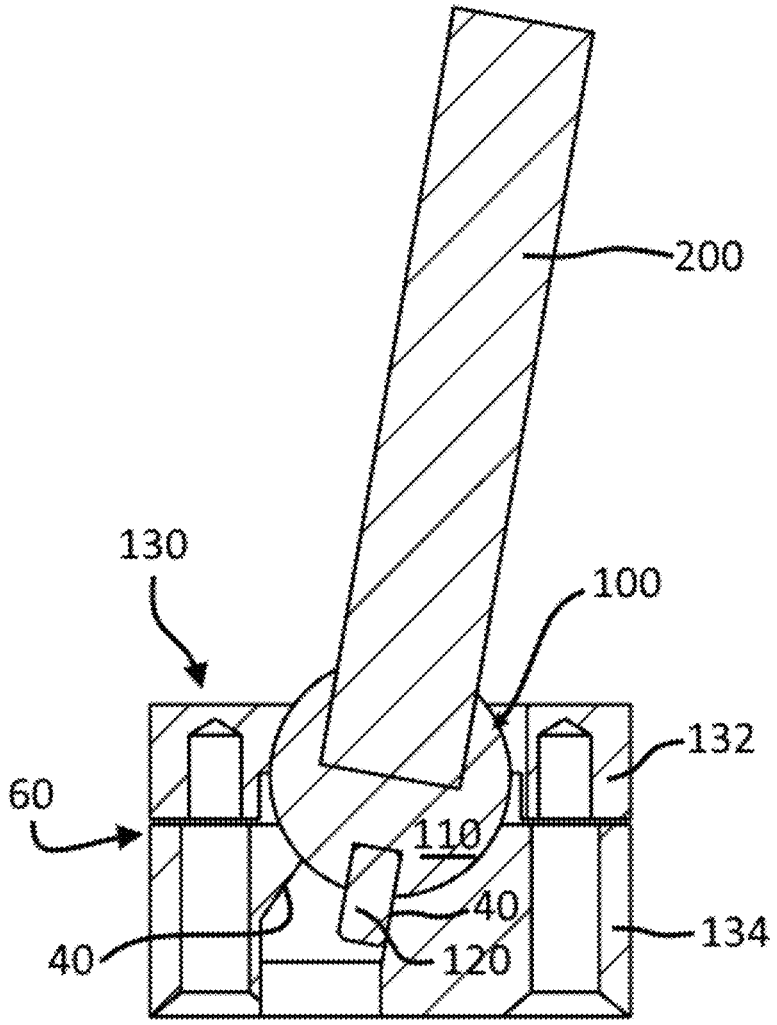
FIG. 24 is a side sectional view of an embodiment of the rotating mechanism with the limiting walls wherein the shaft may rotate on only one side of the vertical axis of the club head.
Figure 25:
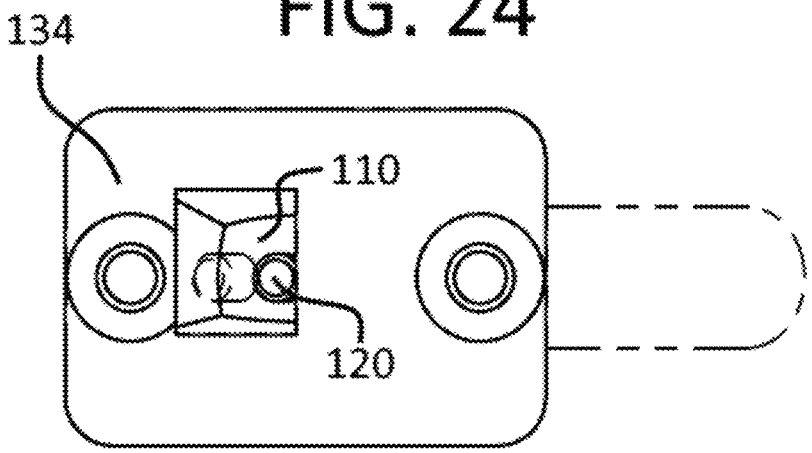
FIG. 25 is a bottom view of the embodiment of FIG. 16.

Another embodiment may be observed in FIG. 24, which shows a sectional view of a second limiting mechanism embodiment. In this embodiment, the shaft 200 may only be positioned on one side of the club head's 10 vertical axis. Specifically, the limiting walls are shaped based on the limiter's 120 diameter so that the shaft 200 may be positioned at an angle of 10 degrees to 35 degrees from the vertical axis. Walls 40 may also be manufactured so as to have any value required by golfing authorities. FIG. 25 further shows the configuration of the embodiment of FIG. 24, but from a bottom view. It may also be appreciated from this view that limiting walls 40 are designed to stop the limiter 120 once the shaft 200 is at the maximal angular limits allowable by golf ruling authorities. The angulations of this embodiment are generally applicable on the plane parallel to the striking surface of the club head 10, therefor to and from the player's position. For example, in a preferred embodiment, the top of the shaft may rotate from 10 to 35 degrees towards a player. As noted above, the dimensions and angular values may be modified to any other value as required by a player and allowable by golfing ruling authorities.

Both previous embodiments may be coupled together in order to allow limited rotation of a sphere 110 around three axes, thus providing players the choice of any angular position of the shaft in regard to a club head as long as it is in the confines of the limitations of golfing ruling authorities or the manufacturer's choice.

Back to FIGS. 22 and 24, a retaining block 130 may be made of at least two parts. As shown, the retaining block 130 comprises two portions, one upper 132 and one lower 134. The top portion 132 may function the same as in other embodiment presented before wherein the bottom portion 134 may also be detachable. The bottom portion 134, being detachable, may be changed by another one with different properties, such as material, weight or limiting walls 40 angles. Furthermore, different securing mechanism may be used to secure the retaining block 130 to the club head 10 and restrain the movements of the rotating mechanism 100. One such mechanism may be the use of screws going through both the lower 134 and upper 132 portions. As such, screws may be slightly unscrewed to allow the sphere 110 to rotate between both portions (132, 134) before being screwed again when at a desired angle. Hence, it may not be necessary to completely uninstall a section in order to adjust the shaft's 200 position.

Figure 26:
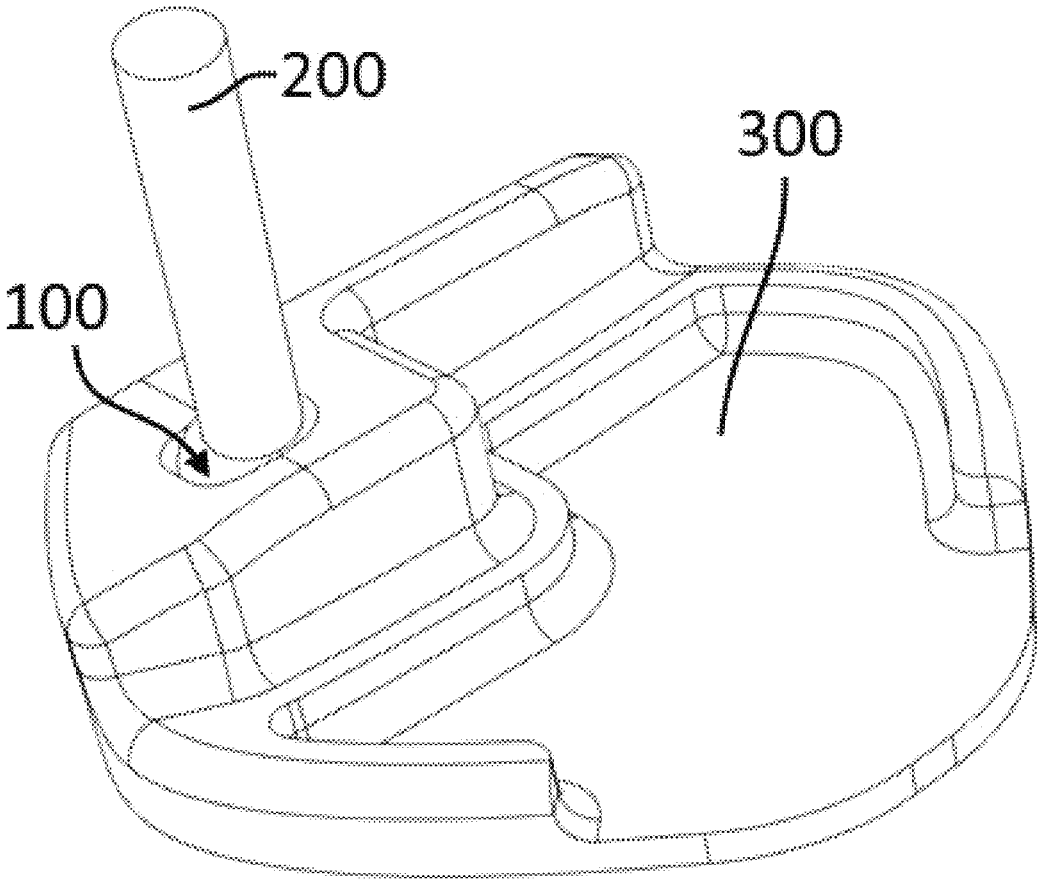
FIG. 26 is a perspective view of an embodiment of the invention wherein the rear of the club head is a circle.

FIG. 26 further shows an embodiment of the invention wherein the club head 300 has a substantially round shape. In this embodiment, the rotating mechanism 100 is installed in a retaining block 130 comprising a detachable bottom portion 134. In this instance, the top portion 132 is the club head 300 itself and may thus not be detachable. Just like in FIG. 13, the bottom portion 134 has cavity walls 40 delimiting the angular limits of the limiter 120 of the sphere 110. The bottom portion 134 is secured by screws which protrude in the club head 300 when tightened. The screws head may be accessible from the bottom of the club head 300 for easy access.

Figure 27:
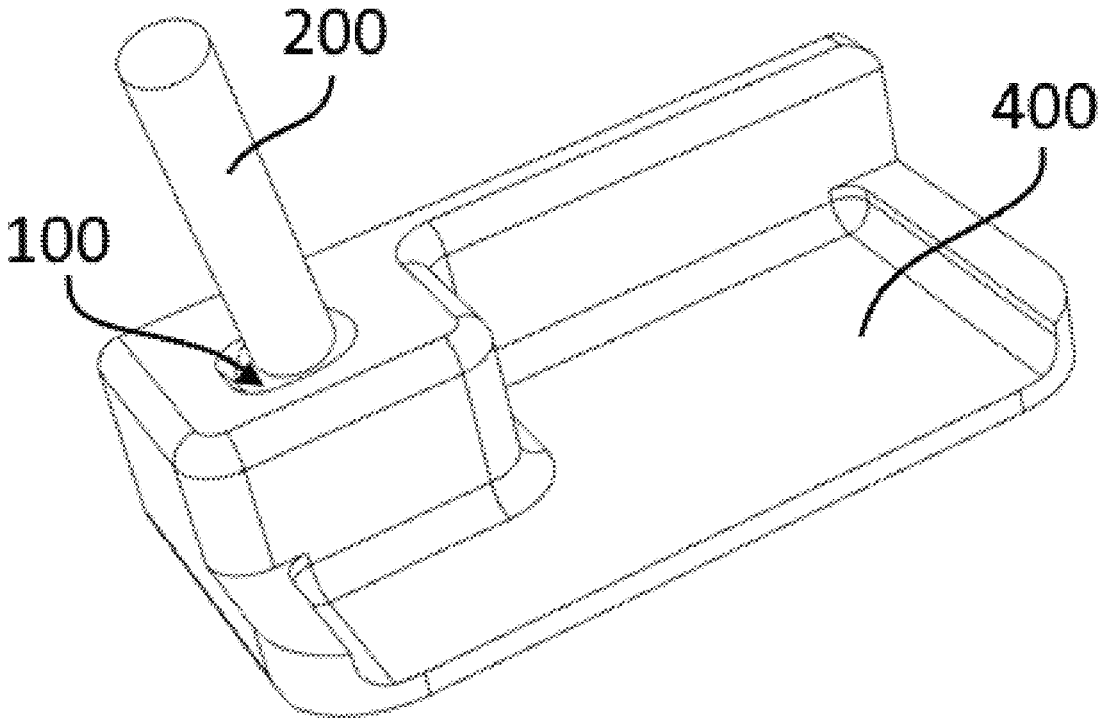
FIG. 27 is a perspective view of an embodiment of the invention wherein the rear of the club head is a rectangle.
Figure 28:
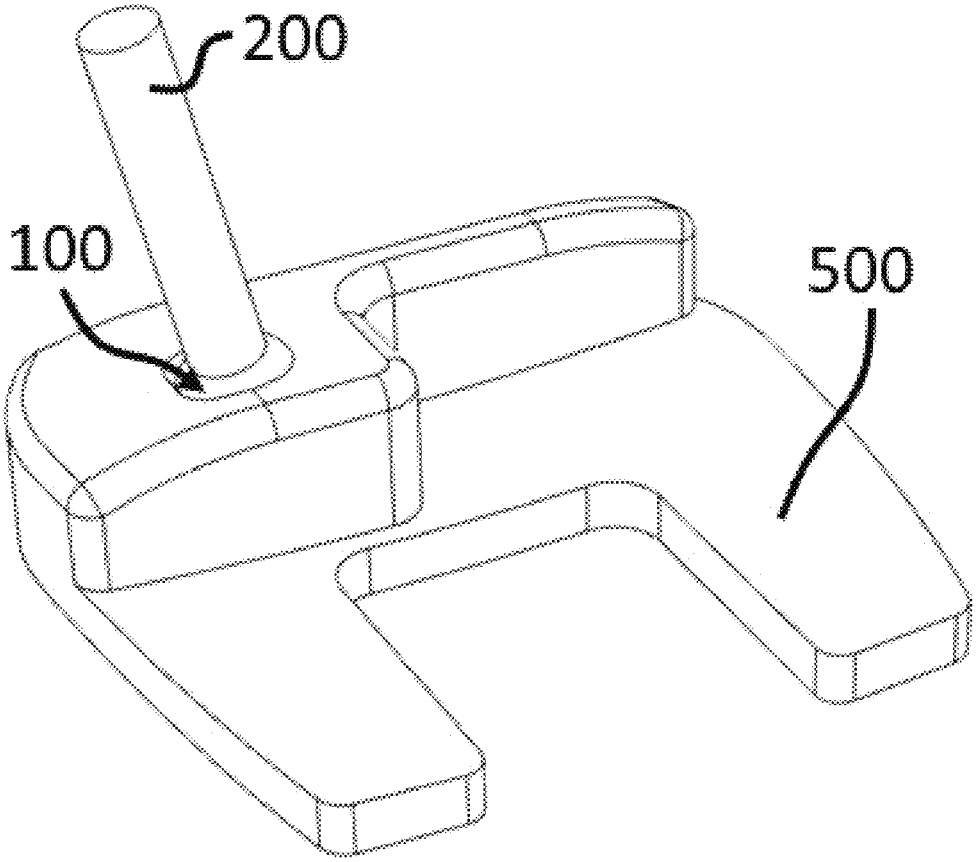
FIG. 28 is a perspective view of an embodiment of the invention wherein the rear of the club head is a horseshoe.

Now referring to FIGS. 27 and 28, the club head 300 of the embodiment of FIG. may further be shaped differently. In FIG. 27, the club head 400 has a substantially rectangular shape wherein the club head 500 of FIG. 28 is shaped like a "horseshoe". In both embodiment, the rotating mechanism 100 and retaining block 130 may be similar to the ones of FIG. 26. A player may thus change the shape of its club head (10, 300, 400, 500 and 600) between matches while keeping the same shaft 200, rotating mechanism 100 and limiting mechanism.

Figure 29:
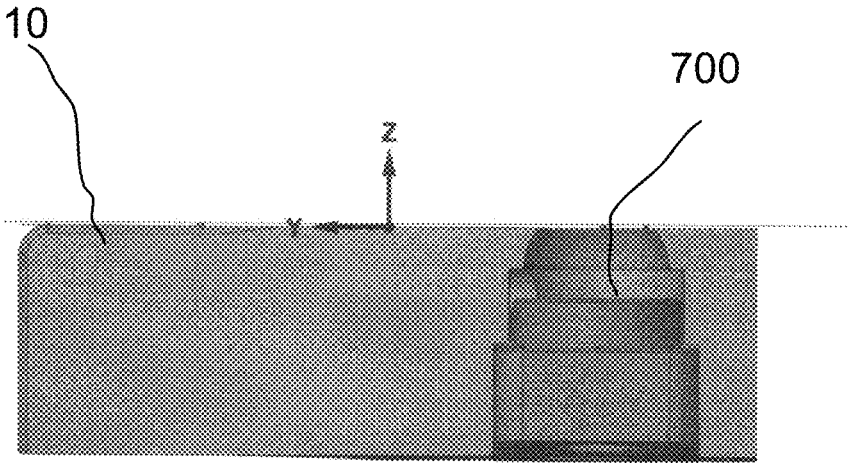
FIG. 29 is a side cross sectional view of an embodiment of the invention wherein the rear of the club head is a horseshoe.
Figure 30:
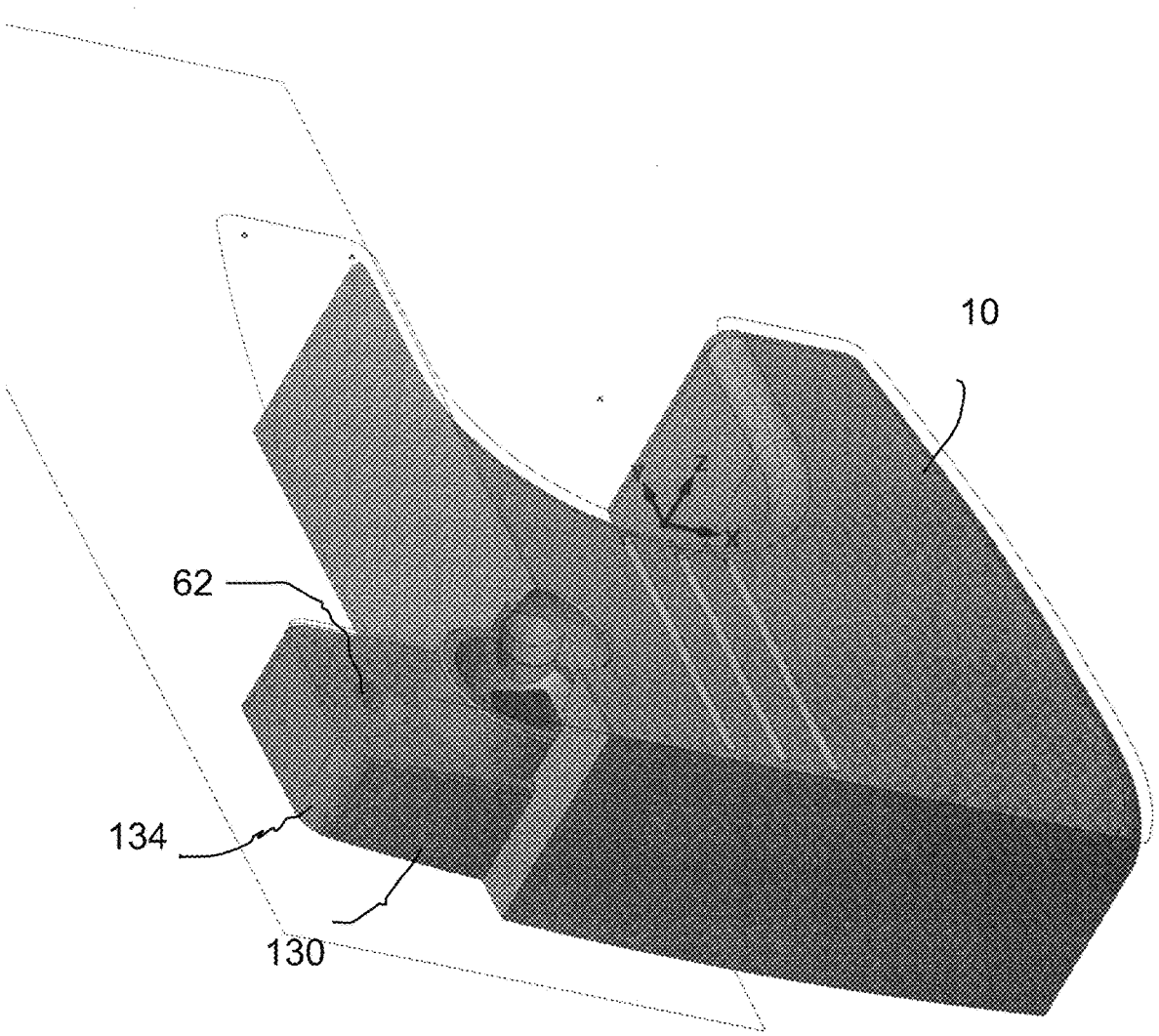
FIG. 30 is a partially cut away perspective view of an embodiment of the invention wherein the rear of the club head is a horseshoe.
Figure 31:
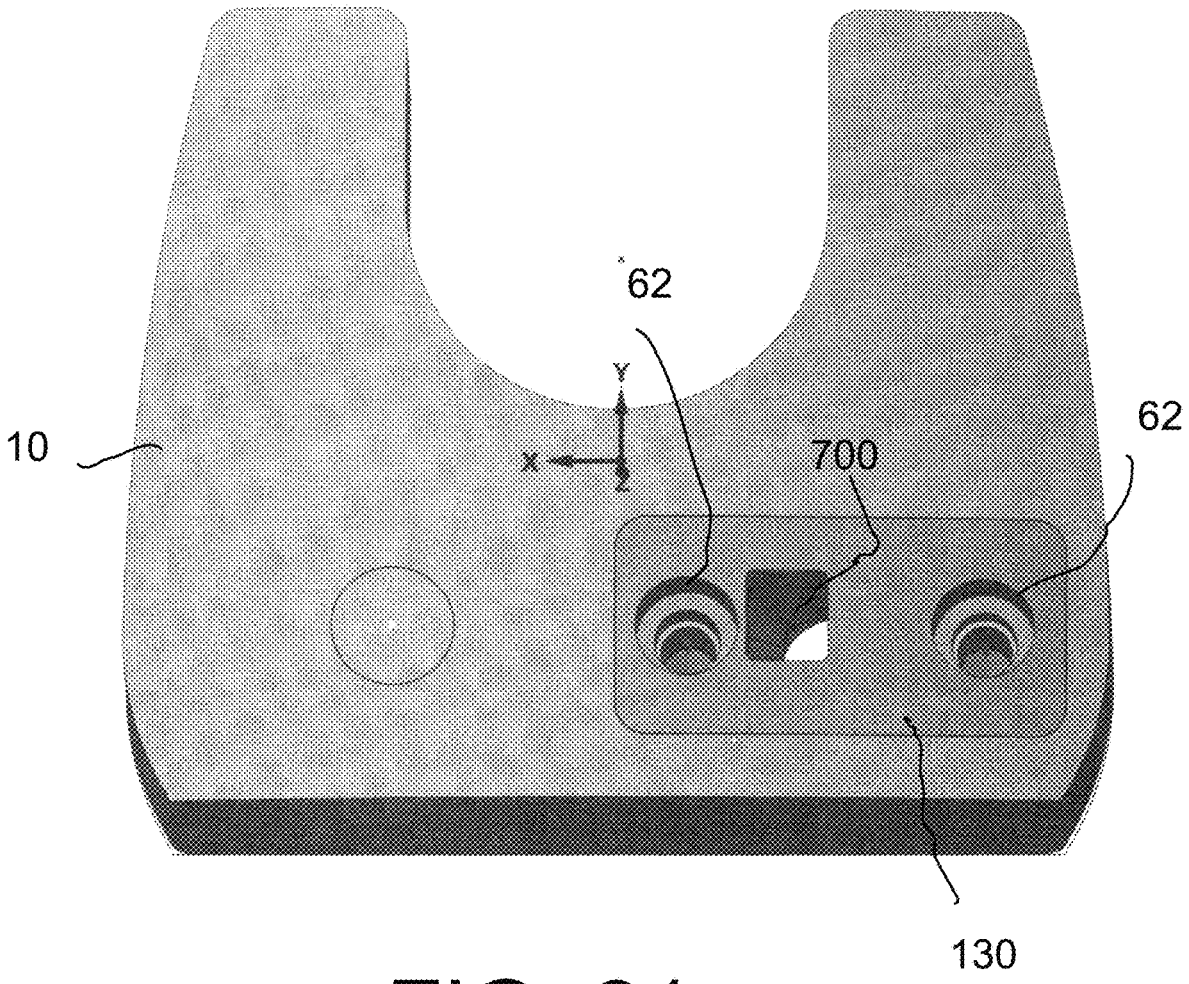
FIG. 31 is a bottom view of an embodiment of the invention wherein the rear of the club head is a horseshoe.

Referring now to FIGS. 29-31, club head may include retaining block 130 with a lower 134 that may lock the position of the shaft via a pair of set screws through screw cavities 62. Block 130 includes gap 700 to provide space for the governor that allow the sphere and retaining unit to be moved, positioned, and set in pace. The locking via set screws retains the orientation of the shaft to allow for legal play. The selection of a unique screw head (rather than Philips) will allow security against modification while in play (on the greens/course).

The material used to manufacture the embodiments of this invention may be any material known in the art of golf clubs and which may be manufactured as to have dimensions precise enough for the invention to be functional. Such materials may be, but are not limited to, metal, polymer or metal-based compositions that are adequate and respect safety standards set by golfing ruling authorities.

A method for adjusting the shaft 200 angle of a golf club is also provided. The method comprises providing a golf club head (10, 300, 400, 500 and 600) with a spherical cavity 20. The method further comprises inserting a rotating mechanism 100 into the spherical cavity 20 so that a sphere 110 of the mechanism is tightly in contact with the cavity walls 20, a shaft 200 protruding up and limiter 120 protruding down if comprised. Next, the method comprises installing a covering plate 50 over the sphere. The method also comprises rotating the sphere 110 until any one of the limiter 120 or shaft 200 is in contact with respective limiting walls 40 or limiting top opening sides and until the shaft 200 is at a desired angulation. Once the rotating mechanism 100 is at the desired position, the method comprises fastening a covering plate 50 over the sphere 110 until the sphere 110 may not be rotated anymore.

In another embodiment, the method comprises the steps of providing a golf club head (10, 300, 400, 500 and 600) with a retaining block cavity 30. The method further comprises inserting a rotating mechanism 100 with shaft 200, comprising a retaining block 130, into the cavity 30. The rotating mechanism may also comprise a limiter 120. Once the retaining block 130 is inserted, the sphere 110 may be rotated until any one of the limiter 120 or shaft 200 is in contact with respective limiting walls 40 or limiting top opening sides of the retaining block 130 and until the shaft 200 is at a desired angulation. Once the rotating mechanism 100 is at the desired position, the method comprises fastening the retaining block 130 until the sphere 100 may not be rotated anymore.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A golf club, the club comprising:

a club head with a striking surface and comprising a retaining block cavity;

a rotating mechanism comprising a sphere and a retaining block; and a shaft;

wherein the retaining block cavity is fitted to receive the retaining block;

the retaining block is comprised of at least two portions;

the retaining block is installed in the retaining block cavity;

the sphere comprises a shaft attachment means;

the shaft is installed in the shaft attachment means of the sphere;

the club head comprises a cavity to let the shaft pass there through; and the retaining block limits the movements of the sphere by covering at least part of the sphere and by putting pressure on the sphere.

2. The golf club of claim 1, wherein the rotating mechanism comprises a limiter fixed to the sphere.

3. The golf club of claim 2, wherein the retaining block comprises a limiting cavity located under the sphere.

4. A golf club comprising:

a club head comprising a retaining block cavity;

a shaft coupled to a sphere along an end of the shaft, wherein a rotating mechanism comprises the sphere and a retaining block at least partially set within said retaining block cavity;

wherein the retaining block comprises an opening along a top of the retaining block to provide space for a portion of the sphere;

wherein the sphere comprises a limiter set on an outer surface of the sphere.

5. The golf club of claim 4, wherein the sphere comprises a limiter hole, wherein the limiter is installed in the limiter hole, and the retaining block comprises a lower portion having a limiting cavity set around the limiter.

6. The golf club of claim 4 further comprising a bottom hole in a bottom of retaining block providing access to the limiter through the bottom of the club head.

7. The golf club of claim 4, wherein the limiting cavity has angulated walls so that the shaft cannot move out of pre-determined angular values relative the club head.

8. The golf club of claim 7, wherein the club head comprises a vertical axis and a striking face and a plane parallel said striking face, a back direction opposite said striking face from said shaft, a forward direction towards said striking face from said shaft, and wherein the angular values of the angulated walls being 10 degrees in said forward direction and 20 degrees in said back direction, said angulated walls having angular values between 10 to 35 degrees in said plane parallel said striking.

9. The golf club of claim 4 wherein the retaining block comprises an upper portion with a lower portion nested into the upper portion and further comprising at least one screw set through said upper and lower portions and contacting said sphere.

10. The golf club of claim 4 wherein the retaining block comprises an upper portion with a lower portion nested into the upper portion wherein said upper portion is integrated to and part of the club head.

11. The golf club of claim 4 wherein the sphere is housed within the retaining block.

12. The golf club of claim 4 wherein the retaining block comprises an upper portion with a covering plate having an opening allowing the shaft to rotate therethrough.

13. The golf club of claim 4 wherein the retaining block is sealed and filled with a fluid.

* * * * *